US010598459B2

(12) United States Patent
Jakob

(10) Patent No.: US 10,598,459 B2
(45) Date of Patent: Mar. 24, 2020

(54) ELECTRONIC SIMULATION DEVICE FOR WEAPON

(71) Applicant: Green Ammo AS, Skien (NO)

(72) Inventor: Eriksroed Ole Jakob, Skien (NO)

(73) Assignee: GREEN AMMO AS, Skien (NO)

( * ) Notice: Subject to any disclaimer, the term of this patent is extended or adjusted under 35 U.S.C. 154(b) by 244 days.

(21) Appl. No.: 15/310,310

(22) PCT Filed: May 13, 2015

(86) PCT No.: PCT/NO2015/050082

§ 371 (c)(1),
(2) Date: Nov. 10, 2016

(87) PCT Pub. No.: WO2015/174852

PCT Pub. Date: Nov. 19, 2015

(65) Prior Publication Data

US 2017/0268845 A1 Sep. 21, 2017

(30) Foreign Application Priority Data

May 14, 2014 (NO) ..... 20140615

(51) Int. Cl.

| | |
|---|---|
| ***F41A 33/00*** | (2006.01) |
| ***F41A 33/06*** | (2006.01) |
| ***F41A 33/02*** | (2006.01) |
| ***F41A 33/04*** | (2006.01) |

(52) U.S. Cl.

CPC ..... *F41A 33/00* (2013.01); *F41A 33/02* (2013.01); *F41A 33/04* (2013.01); *F41A 33/06* (2013.01)

(58) Field of Classification Search

CPC ..... F41A 33/00; F41A 33/02; F41A 33/04; F41A 33/06; F41G 3/26; F41G 3/2655

See application file for complete search history.

(56) References Cited

U.S. PATENT DOCUMENTS

| | | | | |
|---|---|---|---|---|
| 3,220,732 | A | 11/1965 | Pincus | |
| 4,416,631 | A | 11/1983 | Dawson et al. | |
| 5,244,431 | A | 9/1993 | D'Andrade | |
| 5,857,854 | A | 1/1999 | Kwalwasser | |
| 8,770,978 | B2 | 7/2014 | Botten | |
| 2008/0127538 | A1 | 6/2008 | Barrett et al. | |
| 2011/0281242 | A1* | 11/2011 | Charles | F41A 33/02 434/16 |
| 2011/0318715 | A1 | 12/2011 | Markert et al. | |

(Continued)

FOREIGN PATENT DOCUMENTS

| | | | |
|---|---|---|---|
| CN | 2309555 | Y | 3/1999 |
| DE | 3631262 | A1 | 3/1988 |

(Continued)

OTHER PUBLICATIONS

Search Report in International Application No. PCT/NO2015/050082 dated Sep. 9, 2015, 2 pages.

(Continued)

*Primary Examiner* — Timothy A Musselman
(74) *Attorney, Agent, or Firm* — Marshall, Gerstein & Borun LLP

(57) ABSTRACT

A device for simulation of the mechanical functions of a real weapon using electronic and mechanical solutions is described. The simulation device can be mounted on a real weapon.

16 Claims, 4 Drawing Sheets

(56) References Cited

U.S. PATENT DOCUMENTS

| | | | | |
|---|---|---|---|---|
| 2014/0065577 | A1 | 3/2014 | Quinlan et al. | |
| 2014/0272806 | A1* | 9/2014 | Hunt | F41A 33/00 434/16 |

FOREIGN PATENT DOCUMENTS

| | | | |
|---|---|---|---|
| GB | 2259559 | A | 3/1993 |
| NO | 330280 | B1 | 3/2011 |
| WO | WO-2009/025891 | A2 | 2/2009 |

OTHER PUBLICATIONS

International Preliminary Report on Patentability and Written Opinion in International Application No. PCT/NO2015/050082 dated Aug. 5, 2016, 10 pages.
Search Report in NO Application No. 20140615 dated Nov. 24, 2014, 2 pages.
Weapons Law, Circular Directive, V.KM Deactivation Ordinance, KM-DeaktV (BGBI II 314/2012], Nov. 5, 2012, 6 pages.
Office Action in EP Application No. 15 731 413.9, dated Jun. 14, 2018, 4 pages.
Search Report in EP Application No. 15 731 413.9 dated Dec. 11, 2017, 2 pages.
Official action in EP Application No. 15 731 413.9, dated Dec. 7, 2018 (6 pages).

* cited by examiner

ELECTRONIC SIMULATION DEVICE FOR WEAPON

INTRODUCTION

The invention is part of a device for electronic simulation of live fire ammunition upon firing a weapon.

BACKGROUND

Blank ammunition is used in substantial amounts globally. Blank ammunition is a disposable consumer product which may be left in the nature after use. As it is made of plastic and metal, the decomposition process will be very long-lasting and therefore adversely impact the environment. Also, considerable amounts of environmentally harmful waste are produced by the use of powder charge.

Blank ammunition has limitations concerning where it can be used, as fouling will leave marks and pollute the environment where it is used. Examples of use are indoor training in buildings, airplanes, or other civil installations where training is necessary. The use of blank ammunition involves a safety risk as particles are shot out of the barrel and heat could cause personal injury or damage objects in the vicinity of the weapon. Additionally, the use of blank ammunition may cause hearing impairment as the noise level is very high.

Blank ammunition also causes wear and tear of the weapon. Sediments in the barrel increase the need for cleaning the weapon. Blank ammunition has a tendency to jam in bolts and often ruins exercise drills and other training.

Additionally, the purchase cost of blank ammunition is high.

Prior art solutions exist for the artificial simulation of weapon usage by means of artificial simulation weapons such as replica training weapons, toy guns, gas-based weapons, and soft-guns, for example. However, weapon simulation using such weapons does not give the operator any realistic simulation of weapon handling.

SUMMARY OF THE INVENTION

The invention provides a solution to the above problems.

The invention relates to a device for simulation of mechanical functions of a weapon. The invention provides a device for simulation of mechanical functions of a weapon, comprising a weapon bolt simulator simulating the mechanical movements of the weapon bolt. The device is adapted to be mounted on a real weapon to simulate the mechanical functions of a real weapon.

The device may further include a reload simulator for simulating the function of a reload handle of the real weapon. The weapon bolt simulator may be adapted to be mounted as a bolt inside the real weapon. The reload handle simulator may be adapted for activation of the weapon bolt simulator to a first position ready for firing the weapon. The weapon bolt simulator may further be adapted for activation of a hammer of the real weapon. The weapon bolt simulator may include a weapon hammer detector for detecting the movement of the weapon hammer. The weapon hammer detector may be adapted upon firing of a shot, for activation of simulated movements and functions as performed by a real bolt. The weapon bolt simulator may further be adapted for resetting the real hammer of the weapon to a cocked position to simulate the function of a real bolt. The weapon bolt simulator may be adapted to be arranged in a forward position ready to carry out a new bolt sequence. The weapon bolt simulator may further include a burst activator device for simulating a burst mode.

The device may include a reload handle detector adapted to be activated by the hammer.

The device may include an electronic sound generator. A contact unit may provide an electric connection between the weapon bolt simulator and an electronic magazine. The electronic magazine may include batteries, electronics, and an electronic sound generator. The electronic magazine may be adapted to be mountable in a magazine well of the real weapon. The weapon hammer detector may be arranged on the contact unit. The device may comprise a muzzle flash simulator for simulating the muzzle flash through the barrel of the weapon. The muzzle flash simulator may further include a light reflecting arrangement arranged on the muzzle of the weapon, with the light reflecting arrangement co-operating with a light source arranged on the weapon.

The invention also provides a device for simulation of mechanical functions of a weapon, the device is adapted to be fastened on the real weapon, the device comprising a muzzle flash simulator for simulating the muzzle flash through the barrel of the weapon. The muzzle flash simulator may further include a light reflecting arrangement arranged on the muzzle of the weapon. The light reflecting arrangement may co-operate with a light source disposed on the weapon.

The device may further comprise a muzzle flash simulator simulating the muzzle flash through the barrel of the weapon. A trigger detector may detect the movement of the weapon hammer upon firing of a shot. The device may further be provided with a reload handle simulator simulating the function of a reload handle of a weapon.

The weapon bolt simulator may be mounted on and demounted from a real weapon.

To simulate live ammunition it is in addition to gunshot sound important to simulate the mechanical functions of the weapon in order to achieve a normal standard procedure of weapon handling. The present invention ensures a realistic simulation of the normal standard procedure of weapon handling and a realistic simulation of the mechanical functions of the weapon. The present invention is mounted in a real weapon, and the trigger and the hammer of the real weapon are used. The weapon is the operator's personal weapon which is also used for firing live ammunition.

The operator reloads before the first shot. The weapon bolt simulator simulates the movements and reaction of a real weapon bolt during reloading. The operator recognizes the reaction of the weapon bolt simulator and may then unsecure and prepare to fire his real weapon.

When a real weapon fitted with the simulation device of the invention is fired, the weapon bolt simulator carries out the same movements as a real bolt would do and has as its main purpose to reset the hammer of the weapon to a cocked position so that the operator is able to fire a new shot. This mechanical function of the weapon bolt simulator is performed in a similar manner as a real bolt.

When a new magazine is inserted, the bolt release («bolt release» button) of a real weapon is pressed in to make the weapon ready for a new shot. The weapon bolt simulator of the invention simulates the movements and reaction of a real bolt when the bolt release is activated. The bolt release activates a bolt release detector on the magazine that starts the weapon bolt simulator. The operator recognizes the reaction of the weapon bolt simulator and may then unsecure and prepare to fire his real weapon.

The invention may be manufactured from components that do not contain environmentally unfriendly substances. As the shot is simulated by way of electronic and mechanical means, it will not produce any form of exhaust during use. It can be reset and reloaded and will be reusable many times. The invention may be recycled as a normal electric article at the end of its useful life.

The electronic blank ammunition according to the invention produces no waste products that leaves marks or pollutes the environment. This makes training in facilities for which no solutions were previously available more realistic. Moreover, the invention produces no waste products that are exposed in high speed or that produces heat and therefore involves no risk for humans or objects. The invention may have an adjustable sound level, so that the risk of hearing impairment is reduced. The invention neither leaves any marks in the weapon nor involves any risk of jamming, and will hence be more reliable in use. Additionally, the electronic blank ammunition can be used many times, making the product a far more inexpensive solution in terms of purchase costs.

BRIEF DESCRIPTION OF THE DRAWINGS

Exemplary embodiments of the invention will now be described with reference to the drawings, in which.

DETAILED DESCRIPTION

Figure 1:
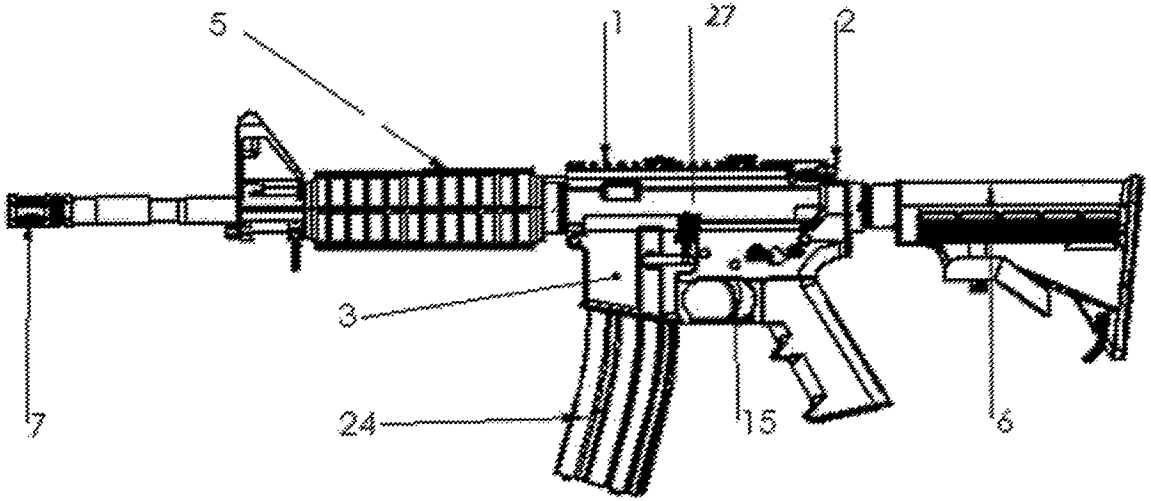
FIG. 1 shows a real weapon in a normal condition.

FIG. 1 shows a weapon 5 of the type AR15 in a normal condition. The weapon includes:

1: Upper receiver
2: Reload handle
3: Lower receiver
24: Magazine
6: Buttstock
7: Muzzle brake
14: Hammer (FIG. 2)
15: Trigger
27: Bolt release FIG. 3 shows a real reload handle, a real trigger, and a real bolt for the weapon of FIG. 1.

2: Reload handle: Pulled back in order to carry bolt 23 backwards into the buttstock 6 to enter a first shot into the chamber of the weapon 5.

15: Trigger: Pressed in to fire a shot and releases the hammer 14.

23: Bolt: Detonates powder in the cartridge on movement of the hammer 14, and then pushes down hammer 14 to a position ready for the next shot.

24: Magazine: Container for live rounds.

31: Burst flip. When activated, shots are fired in burst mode when trigger 15 is pressed and held in.

33: Burst activator: Located on the bolt 23 of a real weapon. When the bolt is pulled forward, the burst activator will press burst flip 31 forward.

When shooting is started, a reload is performed. This is accomplished by pulling reload handle 2 and bolt 23 backwards into buttstock 6 so that a first shot can be fetched from the magazine 24. This shot is pushed into the chamber of the weapon when bolt 23 advances to the forward position as reload handle 2 is released. The weapon is now ready to be fired.

The firing of a shot is accomplished by depressing trigger 15, which releases hammer 14. Hammer 14 then hits bolt 23, which in turn detonates the powder charge in the cartridge. A shot is fired and a flame from the explosion is shown in the muzzle flash brake. The energy of the explosion pushes bolt 23 back into buttstock 6 and compresses the buttstock buffer 19. Hammer 14 is pressed down by bolt 23 to the same position as before the shot was fired. A new cartridge is lifted from magazine 24 and pushed into the chamber. This is caused by the buttstock buffer 19, which presses bolt 23 to its forward position. The weapon is once again ready to be fired.

The invention is a unit intended for being mounted in a real weapon 5 in order to simulate the mechanical functions of the weapon using electronic and mechanical means. The device for simulating the mechanical functions of a weapon 5 comprises a weapon bolt simulator 16 simulating the mechanical movement of the bolt 23 of the weapon 5. The weapon bolt simulator 16 is adapted to be arranged as a bolt inside the real weapon. The weapon bolt simulator may include a hammer detector 20 for detecting the movement of hammer 14. The weapon bolt simulator may include a burst activator device 30 for simulating burst shooting (burst mode). A muzzle flash simulator 8/22 simulates the muzzle flash through the barrel 7 of the weapon 5. A hammer detector 20 detects movement of hammer 14 when a shot is fired. A reload simulator 10 simulating the function of a reload handle 2 of a weapon 5. An electronic sound generator. A contact unit 12 for providing electronic connections between the electronic components of the unit and to a magazine 4 containing batteries, electronics, and the electronic sound generator.

In the explanation that follows, the invention is shown on a weapon of type AR15, but the invention is intended to be adaptable to any type of weapon.

The simulation unit is mounted inside the weapon 5. This requires initially removal of the real weapon parts of the weapon. First, the weapon 5 is broken so that the bolt 23, reload handle 2, and buffer 19 of the weapon 5 can be removed.

The simulation device may then be mounted into the real weapon.

A front assembly 25 is mounted in bolt chamber 23. A rear assembly is mounted in buttstock 6 in the position of buffer 19. A contact unit 12 is mounted between the upper receiver 1 and lower receiver 3. An electronic magazine is inserted in the magazine well of the weapon. (The electronic magazine may be similar to that of WO2011/043673, owned by the same applicant as the present invention.) The weapon is unbroken and is ready for use.

Figure 2:
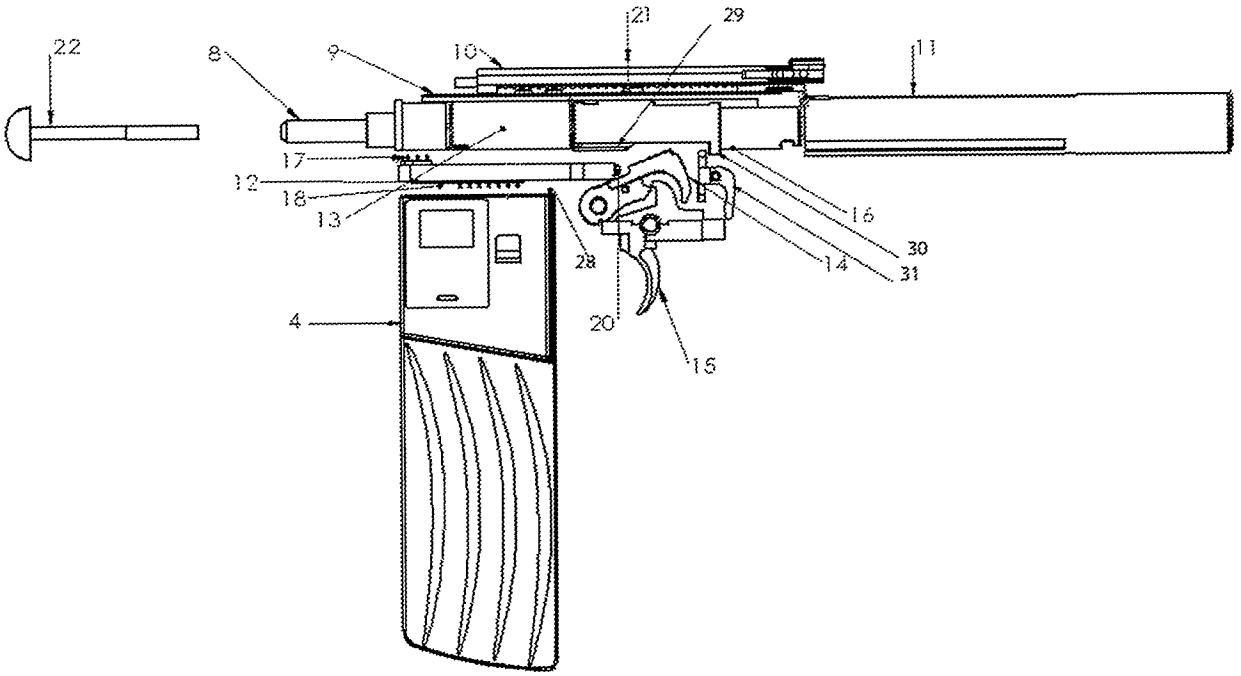
FIG. 2 shows an electronic simulation device according to an embodiment of the present invention.
Figure 3:
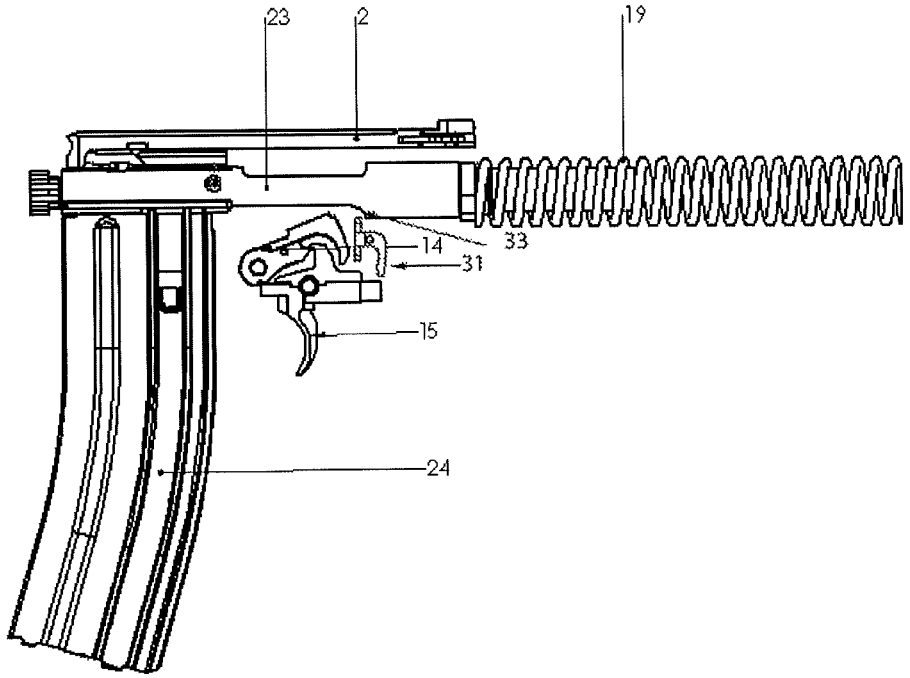
FIG. 3 shows a real reload handle, a real trigger, and a real bolt for the real weapon of FIG. 1.

FIG. 2 shows an electronic simulation device according to an embodiment of the present invention.

4: Electronic magazine containing control electronics of the system, batteries, a display, and a sound generator.

8: Muzzle flash simulator: Contains a light emitter that transmits a ray of light through the barrel of the weapon 5 to indicate that a shot has been fired. Simulating the muzzle flash through barrel 7 of weapon 5. The muzzle flash simulator may include a light reflecting arrangement 22 mounted to the muzzle of the weapon 5. The light reflecting arrangement co-operates with the light source 8 mounted on the weapon.

9: Circuit board. An electronic circuit board for applying a voltage pulse to the front 13 and rear 11 electromagnets also contains a reload handle detector 21.

10: Reload simulator: Simulates the reload handle 2 of the weapon 5 by being pulled back to simulate the first reload.

11: Rear electromagnet: Pulls back bolt simulator 16 into the buttstock 6 of the real weapon to simulate the movement of the real bolt 23. When the rear electromagnet pulls back bolt simulator 16, weapon bolt simulator 16 resets the real hammer 14 of the weapon to the cocked position in order to simulate the function of a real bolt 23.

12: Contact unit: Connects the electronic magazine 4 electronically to the front 13 and rear 11 electromagnets, muzzle flash simulator 8, and reload handle detector 21. The contact unit includes a hammer detector 20.

13: Front electromagnet. Pulls back bolt simulator 16 to the forward position in order to simulate the movement of the real bolt 23. In the forward position, the weapon bolt simulator is ready to carry out a new bolt movement sequence.

14: Hammer: Released by the trigger 15 of the real weapon, and activates a hammer detector 20.

15: Trigger: Pressed in to fire a shot and release hammer 14.

16: Bolt simulator: Simulates the real bolt 23 of the weapon during movement. The movement is caused by a voltage pulse applied to the front 13 and rear 11 electromagnets. The weapon bolt simulator presses down hammer 14.

17: Upper electronic contacts: Electronic spring pins for electronically connecting contact unit 12 and weapon bolt simulator 16.

18: Lower electronic contacts: Electronic spring pins for electronically connecting the contact unit 12 and electronic magazine 4.

In the embodiment of FIG. 2, the upper and lower electronic contacts 17 and 18 are located on the top side and underside of the contact unit 12, respectively.

19: Buffer: Pushes bolt 23 to the forward position after a shot has been fired.

20: Hammer detector: The hammer detector is located on contact unit 12. The hammer detector may be a micro switch that is activated when reload simulator 10 is fully retracted. Activates the electronic magazine 4 to simulate reload action.

21: Reload handle detector: Micro switch that is activated when hammer 14 is released by trigger 15. Activates the electronic magazine 4 to simulate a fired shot.

22: Muzzle flash reflector: Scatters a ray of light from the muzzle flash simulator 8 to more clearly indicate the muzzle flash when a shot is fired.

28: The bolt release detector is located on the electronic magazine 4. The bolt release detector is activated when bolt release 27 of the real weapon 5 is depressed.

29: Actuating means for hammer 14: Provided on the underside of weapon bolt simulator 16 to cause it to press down the hammer. In the embodiment of FIG. 2, the actuating means for the hammer is formed as a downwardly projecting sloping edge.

Figure 4:
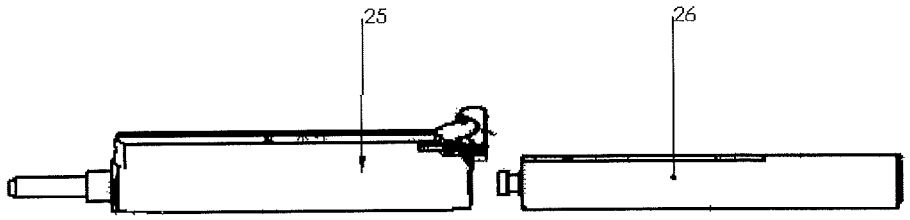
FIG. 4 shows a front assembly and a rear assembly according to an embodiment of the present invention for the electronic simulation device of FIG. 2.

30: Burst activator: Corresponds to the function of the burst activator wing 33 of the bolt 23 on a real weapon. When the weapon bolt simulator is pulled forward, the burst activator device will press the burst flip 31 of the real weapon 5 forward. In FIG. 4, the burst activator device is formed as a downwardly projecting edge.

FIG. 4 shows an embodiment comprising a front assembly and a rear assembly for the electronic simulation device of FIG. 2.

25: The front assembly may comprise: muzzle flash simulator 8, circuit board 9, reload handle simulator 10, front electromagnet 13, reload handle detector 21, and bolt simulator 16.

26: The rear assembly may comprise a rear electromagnet 11 with connections.

Figure 5:
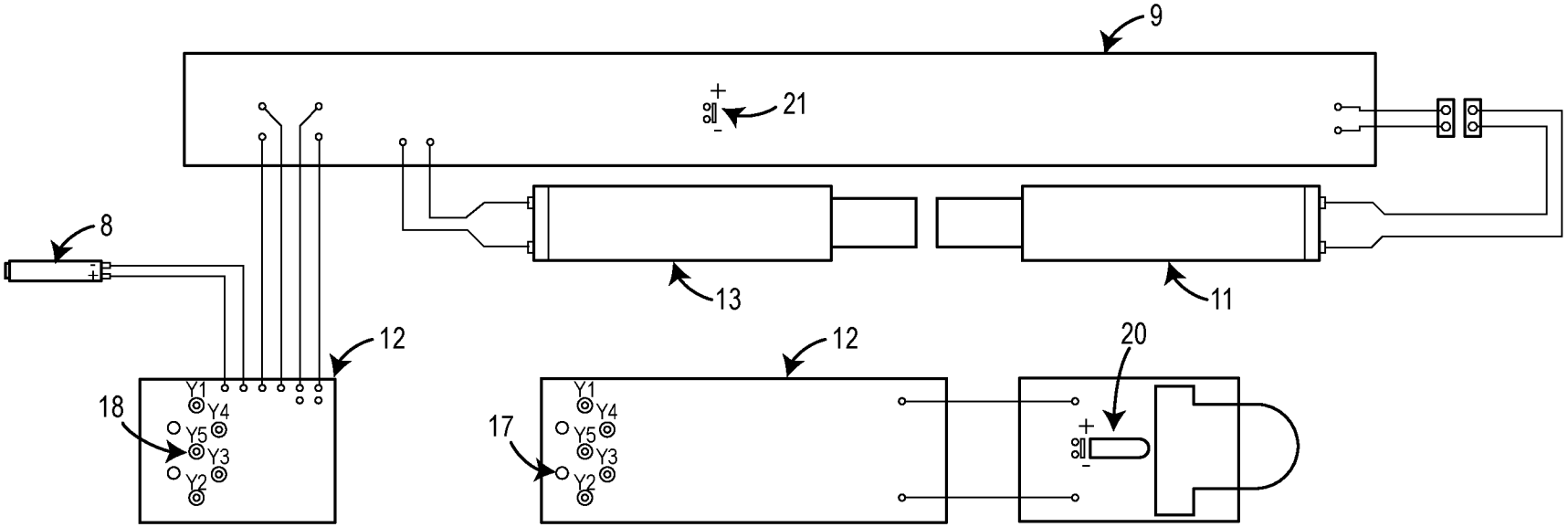
FIG. 5 shows an embodiment of the simulation device according to the present invention.

FIG. 5 shows an embodiment of the simulation device according to an embodiment of the present invention.

8: Muzzle flash simulator: Contains a light emitter that emits a ray of light through the barrel of the weapon 5 to indicate that a shot has been fired.

9: Circuit board: An electronic circuit board to apply a voltage pulse to the front 13 and rear 11 electromagnets. Also includes a reload handle detector 21.

21: Reload handle detector: Micro switch activated when hammer 14 is activated by the trigger 15. Activates the electronic magazine 4 to simulate a fired shot.

11: Rear electromagnet: Pulls the weapon bolt simulator 16 backwards into the buttstock 6 to simulate the movement of the real bolt 23.

12: Contact unit: Connects the electronic magazine 4 electronically to the front 13 and rear 11 electromagnets, muzzle flash simulator 8, and reload handle detector 21. Also contains hammer detector 20.

13: Front electromagnet: Pulls the weapon bolt simulator 16 back to the forward position to simulate the movement of the real bolt 23.

17: Upper electronic contacts: Electronic spring pins for the electronic interconnection.

18: Lower electronic contacts: Electronic spring pins for the electronic interconnection.

20: Hammer detector: Micro switch activated when reload simulator handle 10 is fully retracted. Activates the electronic magazine 4 to simulate reloading of the real weapon.

Simulating Reloading:

To simulate reloading a reload simulator 10 has been made that is pulled back in the same manner as the original reload handle 2. When reload simulator 10 is fully retracted, it will activate reload handle detector 21 located below reload simulator 10. Reload handle detector 21 connects to the electronic magazine 4 via contact unit 12. To simulate that the weapon has been activated and is ready to be fired, simulation of the function of the real bolt 23 is started. The simulation of bolt 23 is accomplished in that a voltage pulse is transmitted from the electronic magazine 4 through contact unit 12 and to the rear electromagnet 11 of the weapon bolt simulator. This causes weapon bolt simulator 16 to be pulled backwards into buttstock 6. Weapon bolt simulator 16 is designed in such a manner that when weapon bolt simulator 16 is pulled backwards into the buttstock, in the same manner as bolt 23, the weapon bolt simulator hits the hammer 14 and the hammer 14 is pressed down so that it is moved to a cocked position. Weapon bolt simulator 16 is then pulled back to the forward position in that a voltage pulse is sent through the contact unit 12 to the front electromagnet 13.

The weapon's hammer is now located in a cocked position and the weapon is ready to be fired.

Simulating a Fired Shot in Single Shot Mode:

Simulation of a real shot is accomplished by depressing trigger 15. The trigger releases the hammer 14 in the same manner as when normal ammunition is fired. The movement of hammer 14 activates the electronic hammer detector 20, which in turn, through contact unit 12, activates the electronics of the electronic magazine 4 to activate a fired shot. The electronics of magazine 4 plays an audio file and simultaneously transfers a voltage pulse through the contact unit to muzzle flash simulator 8. Muzzle flash simulator 8 includes a light source that transmits a ray of light through the barrel to muzzle flash reflector 22 mounted on muzzle brake 7 in order to simulate a muzzle flash. At the same time, the electronics of the electronic magazine 4 also apply a voltage pulse to the rear electromagnet 11 through contact unit 12, so that the weapon bolt simulator 16 is pulled backwards into buttstock 6. The weapon bolt simulator is designed so as to, in the same manner as bolt 23, press down hammer 14 to the position it had before a shot was fired. The electronics of the magazine 4 then applies, through contact unit 12, a voltage pulse to the front electromagnet 13. This causes the weapon bolt simulator 16 to be pulled back to the forward position and the weapon is again ready to be fired.

Simulating a Fired Shot in Burst Mode:

When a shot is fired when the weapon is in burst mode, hammer 14 is released when trigger 15 is depressed on the first shot, similarly to when a shot is fired in single mode as explained above. Hammer detector 20 then initiates the same internal activation sequence in the simulation device as for single shot mode as explained above. However, if trigger 15 is kept depressed when the weapon is in burst mode, subsequent shots are activated automatically by weapon bolt simulator 16. The weapon bolt simulator 16 is formed with a downwardly projecting edge (wing) 30 that interacts with the burst flip 31 of the real weapon 5. This downwardly projecting edge can be referred to as a burst activator device 30. When the weapon bolt simulator 16 is pulled forward, the downwardly projecting edge 30 will press burst flip 31 of the real weapon 5 forwardly so that the hammer 14 is released. This sequence is repeated until the trigger 15 is no longer depressed.

The invention, together with the electronic magazine 4, can be used for the electronic simulation of live ammunition. The invention eliminates the use of blank ammunition. The shot or explosion is replaced by electronics and mechanics instead of gunpowder. The invention will be a replacement or supplement in applications where currently blank ammunition is used.

It should be noted that the embodiments described above are only exemplary embodiments, and that a person skilled in the art will be able to devise a variety of other modifications and variants of the invention within the scope of the invention, as defined in the appended claims.

The invention claimed is:

1. A device for simulation of mechanical functions of a real weapon, wherein the device is adapted to be arranged on the real weapon, the device comprising a bolt simulator for simulating the mechanical movement of the weapon bolt and a reload simulator for simulating the function of a reload handle of the real weapon.

2. Device according to claim 1, wherein the weapon bolt simulator is adapted to be mounted as a bolt inside the real weapon.

3. Device according to claim 1, wherein the reload handle is further adapted to activate the weapon bolt simulator to a first position ready for firing the weapon.

4. Device according to claim 1, wherein the weapon bolt simulator is further adapted to activate a hammer of the real weapon.

5. Device according to claim 1, wherein the weapon bolt simulator further comprises a hammer detector to detect movement of a hammer of the real weapon.

6. Device according to claim 5, wherein the hammer detector is adapted upon firing of a shot to activate simulated movements and functions performed by a real bolt.

7. Device according to claim 1, wherein the weapon bolt simulator is further adapted to reset the real hammer of the weapon to a cocked position to simulate a function of a real bolt.

8. Device according to claim 1, wherein the weapon bolt simulator is further adapted to be arranged in a forward position ready to carry out a new bolt movement sequence.

9. Device according to claim 1, wherein the weapon bolt simulator further comprises a burst activator device for simulating a burst mode.

10. Device according to claim 1, further comprising a reload handle detector adapted to be activated by a real hammer of the weapon.

11. Device according to claim 1, further comprising an electronic sound generator.

12. Device according to claim 1, further comprising a contact unit for providing electronic connection between the weapon bolt simulator and an electronic magazine.

13. Device according to claim 12, wherein the electronic magazine comprises batteries, electronics, and an electronic sound generator, and the electronic magazine is adapted to be arrangeable in a magazine well of the real weapon.

14. Device according to claim 12, wherein a hammer detector to detect movement of a hammer of the real weapon is located on the contact unit.

15. Device according to claim 1, further comprising a muzzle flash simulator for simulating a muzzle flash through a barrel of the weapon.

16. Device according to claim 15, wherein the muzzle flash simulator further comprises a light reflecting arrangement arranged on the barrel of the weapon, the light reflecting arrangement cooperating with a light source arranged on the weapon.

* * * * *